US009677148B2

(12) United States Patent
Tanaka et al.

(10) Patent No.: US 9,677,148 B2
(45) Date of Patent: Jun. 13, 2017

(54) METHOD FOR MANUFACTURING GALVANIZED STEEL SHEET

(71) Applicant: JFE STEEL CORPORATION, Tokyo (JP)

(72) Inventors: Minoru Tanaka, Fukuyama (JP); Yoshitsugu Suzuki, Fukuyama (JP); Mai Miyata, Fukuyama (JP); Yasunobu Nagataki, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 14/649,760

(22) PCT Filed: Nov. 29, 2013

(86) PCT No.: PCT/JP2013/007015

§ 371 (c)(1),
(2) Date: Jun. 4, 2015

(87) PCT Pub. No.: WO2014/091702

PCT Pub. Date: Jun. 19, 2014

(65) Prior Publication Data

US 2015/0315692 A1 Nov. 5, 2015

(30) Foreign Application Priority Data

Dec. 11, 2012 (JP) ..... 2012-269879

(51) Int. Cl.
*C23C 2/02* (2006.01)
*C21D 9/46* (2006.01)
(Continued)

(52) U.S. Cl.
CPC ..... *C21D 9/46* (2013.01); *C21D 1/74* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS

2006/0269776 A1 11/2006 Tanaka
2007/0051438 A1 3/2007 Honda
2013/0180305 A1 7/2013 Warnecke

FOREIGN PATENT DOCUMENTS

CA 2835809 12/2012
CN 1839210 9/2006
(Continued)

OTHER PUBLICATIONS

International Search Report for International Application No. PCT/JP2013/007015 mailed Feb. 25, 2014.
(Continued)

*Primary Examiner* — Nathan T Leong
(74) *Attorney, Agent, or Firm* — RatnerPrestia

(57) ABSTRACT

A method for manufacturing a galvanized steel sheet includes heating a base steel sheet in a heating zone such that the surface of the base steel sheet is heated at a temperature of 600° C. or higher and 790° C. or lower while a furnace temperature T° C. in the heating zone of an annealing furnace is controlled based on the water vapor partial pressure $P_{H2O}^{in\ Air}$ of air fed into the heating zone, the base steel sheet having a chemical composition consisting of, by mass %, C: 0.05% or more and 0.25% or less, Si: 0.1% or more and 3.0% or less, Mn: 0.5% or more and 3.0% or less, P: 0.001% or more and 0.10% or less, Al: 0.01% or more and 3.00% or less, S: 0.200% or less, and the balance being Fe and inevitable impurities, heating the base steel sheet in the heating zone such that the surface of the base steel sheet is heated at a temperature of 630° C. or higher and 850° C. or lower in an atmosphere containing hydrogen gas having a partial pressure $P_{H2O}$ of 1000 Pa or more and 50000 Pa or
(Continued)

less, water vapor gas having a partial pressure $P_{H2O}$ of 610 Pa or less, and the balance being $N_2$ and inevitable impurities, and galvanizing the base steel sheet.

8 Claims, 1 Drawing Sheet

(51) Int. Cl.

| | |
|---|---|
| ***C23C 2/40*** | (2006.01) |
| ***C21D 6/00*** | (2006.01) |
| ***C22C 38/58*** | (2006.01) |
| ***C22C 38/54*** | (2006.01) |
| ***C22C 38/50*** | (2006.01) |
| ***C22C 38/48*** | (2006.01) |
| ***C22C 38/44*** | (2006.01) |
| ***C22C 38/42*** | (2006.01) |
| ***C22C 38/38*** | (2006.01) |
| ***C22C 38/34*** | (2006.01) |
| ***C22C 38/32*** | (2006.01) |
| ***C22C 38/28*** | (2006.01) |
| ***C22C 38/26*** | (2006.01) |
| ***C22C 38/22*** | (2006.01) |
| ***C22C 38/20*** | (2006.01) |
| ***C22C 38/16*** | (2006.01) |
| ***C22C 38/14*** | (2006.01) |
| ***C22C 38/12*** | (2006.01) |
| ***C22C 38/06*** | (2006.01) |
| ***C22C 38/04*** | (2006.01) |
| ***C22C 38/02*** | (2006.01) |
| ***C23C 2/06*** | (2006.01) |
| ***C23C 2/28*** | (2006.01) |
| ***C22C 18/04*** | (2006.01) |
| ***C22C 38/00*** | (2006.01) |
| ***C22C 38/60*** | (2006.01) |
| ***C21D 1/74*** | (2006.01) |
| *C21D 9/56* | (2006.01) |

(52) U.S. Cl.

CPC ..... *C21D 6/008* (2013.01); *C22C 18/04* (2013.01); *C22C 38/00* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/20* (2013.01); *C22C 38/22* (2013.01); *C22C 38/26* (2013.01); *C22C 38/28* (2013.01); *C22C 38/32* (2013.01); *C22C 38/34* (2013.01); *C22C 38/38* (2013.01); *C22C 38/42* (2013.01); *C22C 38/44* (2013.01); *C22C 38/48* (2013.01); *C22C 38/50* (2013.01); *C22C 38/54* (2013.01); *C22C 38/58* (2013.01); *C22C 38/60* (2013.01); *C23C 2/02* (2013.01); *C23C 2/06* (2013.01); *C23C 2/28* (2013.01); *C23C 2/40* (2013.01); *C21D 9/561* (2013.01)

(56) References Cited

FOREIGN PATENT DOCUMENTS

| | | |
|---|---|---|
| CN | 102260842 | 11/2011 |
| CN | 102482728 | 5/2012 |
| CN | 102652177 | 8/2012 |
| EP | 1829983 | 9/2007 |
| EP | 2460897 | 6/2012 |
| JP | 04202630 | 7/1992 |
| JP | 06306561 | 11/1994 |
| JP | 3415191 | 6/2003 |
| JP | 2004211157 | 7/2004 |
| JP | 2004315960 | 11/2004 |
| JP | 2007231373 | 9/2007 |
| JP | 2007291498 | 11/2007 |
| JP | 2010132975 | 6/2010 |
| JP | 2011117069 | 6/2011 |
| JP | 2011214042 | 10/2011 |

OTHER PUBLICATIONS

Extended European Search Report mailed Jan. 5, 2016 for European Application No. 13862056.2-1362.

Chinese Office Action for Chinese Application No. 201380063713.6, dated May 3, 2016, including Concise Statement of Search Report, 14 pages.

European Office Action for European Application No. 13862056.2, dated Sep. 12, 2016, 5 pages.

Korean Notice of Allowance for Korean Application No. 10-2015-7015262, dated Dec. 1, 2016, with English translation, 3 pages.

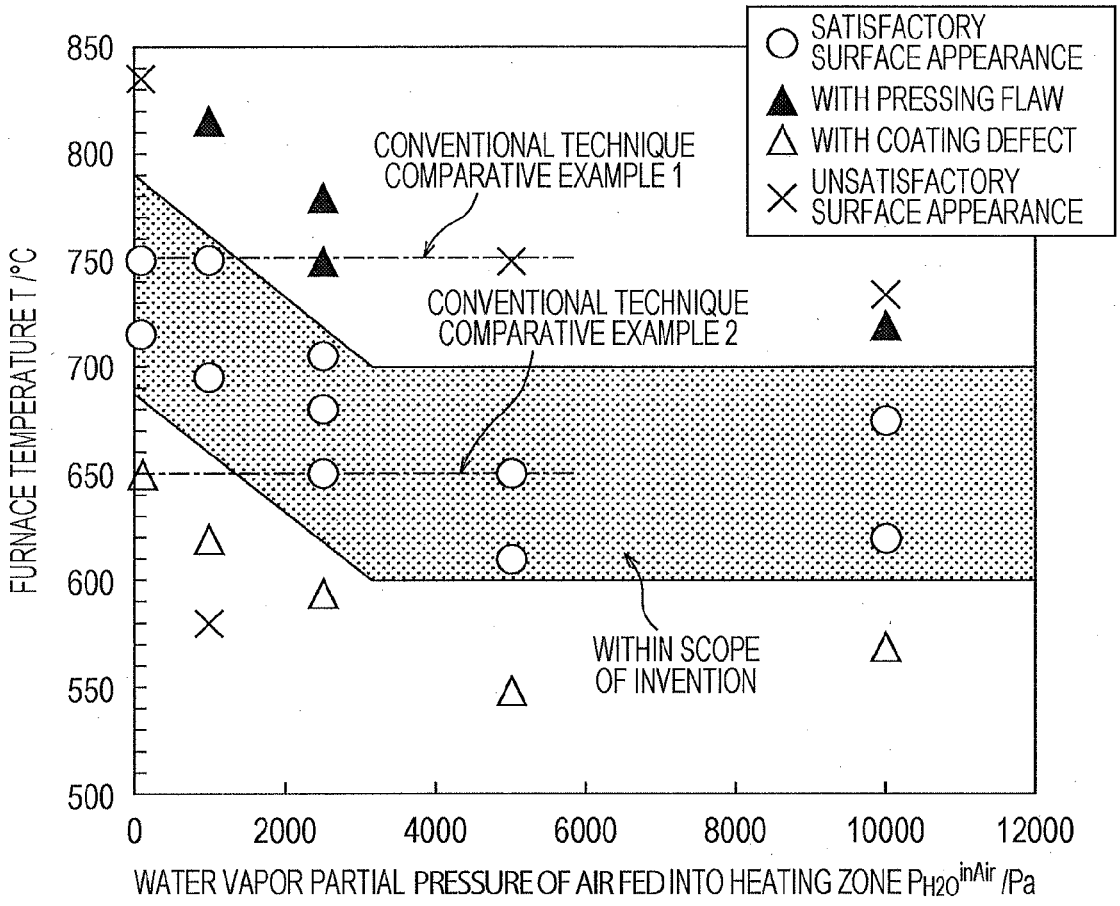
SATISFACTORY SURFACE APPEARANCE
WITH PRESSING FLAW
WITH COATING DEFECT
UNSATISFACTORY SURFACE APPEARANCE
CONVENTIONAL TECHNIQUE COMPARATIVE EXAMPLE 1
CONVENTIONAL TECHNIQUE COMPARATIVE EXAMPLE 2
WITHIN SCOPE OF INVENTION
FURNACE TEMPERATURE T /°C
850
800
750
700
650
600
550
500
0
2000
4000
6000
8000
10000
12000
WATER VAPOR PARTIAL PRESSURE OF AIR FED INTO HEATING ZONE $P_{H2O}^{inAir}$ /Pa

METHOD FOR MANUFACTURING GALVANIZED STEEL SHEET

CROSS REFERENCE TO RELATED APPLICATIONS

This is the U.S. National Phase application of PCT/JP2013/007015, filed Nov. 29, 2013, which claims priority to Japanese Patent Application No. 2012-269879, filed Dec. 11, 2012, the disclosures of each of these applications being incorporated herein by reference in their entireties for all purposes.

FIELD OF THE INVENTION

Aspects of the present invention relate to a method for manufacturing a galvanized steel sheet whose base steel sheet is a Si-containing high-strength steel sheet, in particular, a method for manufacturing a galvanized steel sheet having good surface appearance without surface defects such as coating defects or pressing flaws and having excellent coating adhesiveness.

BACKGROUND OF THE INVENTION

Nowadays, coated steel sheets in which corrosion resistance is given to the base steel sheet, in particular, galvanized steel sheets or galvannealed steel sheets which are excellent in terms of corrosion resistance, are used in the fields of, for example, automobile, domestic electric appliance, and building material.

Generally, a galvanized steel sheet is manufactured using the following method. First, a steel sheet produced by hot-rolling and cold-rolling a steel slab, or followed by heat treatment, is annealed for recrystallization in a non-oxidizing atmosphere or a reducing atmosphere after cleaning the surface of the steel sheet using a degreasing method and/or a pickling method in a pretreatment process, or removing oil on the surface of the steel sheet by combustion in a preheating furnace without performing the pretreatment process. Then, the steel sheet is cooled to a temperature suitable for galvanizing in the non-oxidizing atmosphere or the reducing atmosphere and dipped into a galvanizing bath into which a small amount (about 0.1 to 0.2 mass %) of Al is added, without being exposed to air. With this method, the surface of the steel sheet is galvanized so that a galvanized steel sheet is obtained. In addition, a galvannealed steel sheet is obtained by performing a heat treatment on the galvanized steel sheet in an alloying furnace.

Nowadays, in the field of automobile, since a decrease in weight of steel sheet is promoted along with an increase in performance of steel sheet, a high-strength galvanized steel sheet having corrosion resistance is increasingly being used. An increase in strength of steel sheet is realized by adding chemical elements for solid solution hardening such as Si and Mn. In particular, since Si has the advantage of increasing the strength of steel without decreasing its ductility, a Si-containing steel sheet has potential as a high-strength steel sheet. On the other hand, in the case where a galvanized steel sheet or a galvannealed steel sheet is manufactured using a high-strength steel sheet containing a large amount of Si therein as a base steel sheet, the following problems exist.

A base steel sheet is subjected to annealing in a reducing atmosphere before galvanizing as described above. However, since Si in steel has a high affinity for oxygen, Si is selectively oxidized, even in a reducing atmosphere, so as to form oxides on the surface of the base steel sheet. Such oxides decrease the wettability of the base steel sheet with molten zinc, which results in coating defects at galvanizing. In addition, even in the case where coating defects do not occur, there is a problem of decrease in coating adhesiveness.

Moreover, such oxides significantly decrease an alloying rate in an alloying process after galvanizing. As a result, there is a significant decrease in productivity of galvannealed steel sheet. On the other hand, in the case where alloying treatment is performed at a high temperature in order to achieve high productivity, since there is a problem of decrease in powdering resistance, it is difficult to achieve efficient productivity and sufficient powdering resistance at the same time. In addition, since there is a decrease in stability of residual γ phase by performing an alloying treatment at a high temperature, there is a decrease in effect of adding Si. As described above, it is very difficult to manufacture a high-strength galvanized steel sheet having satisfactory mechanical properties and coating quality at the same time.

In order to solve such problems, some techniques are disclosed. Patent Literature 1 discloses a technique in which the wettability of the base steel sheet with molten zinc is increased as a result of forming a reduced iron layer on the surface of the base steel sheet by performing a reduction annealing after forming oxidized irons on the surface of the base steel sheet in an oxidizing atmosphere. In addition, Patent Literature 2 discloses a technique in which satisfactory coating quality is achieved by controlling oxygen concentration in an atmosphere at preheating. Moreover, Patent Literature 3 discloses a technique for manufacturing a galvanized steel sheet having good surface appearance without coating defects or pressing flaws by dividing a heating zone into three zones called A to C zones and appropriately controlling the temperatures and the oxygen concentrations respectively of the three zones.

PATENT LITERATURE

PTL 1: Japanese Unexamined Patent Application Publication No. 4-202630

PTL 2: Japanese Unexamined Patent Application Publication No. 6-306561

PTL 3: Japanese Unexamined Patent Application Publication No. 2007-291498

SUMMARY OF THE INVENTION

In the case of the techniques according to Patent Literatures 1 and 2 where a galvanizing treatment is performed on high-Si-containing steels using an oxidation-reduction treatment, while coating defects are removed, there is a problem of pressing flaws occurring, the problem being specific to the oxidation-reduction treatment. In addition, in the case of the technique according to Patent Literature 3 where the temperatures and the oxygen concentrations of heating zones A to C are respectively controlled, it is possible to provide a galvanized steel sheet having no surface defects such as coating defects and pressing flaws. However, there is a problem in that the appropriate temperature ranges of the heating zones vary depending on manufacturing conditions (manufacturing plans). That is, in the case where the temperatures of the heating zones are controlled to be certain constant temperatures, there is a case where coating defects and pressing flaws occur under some manufacturing conditions. Therefore, since it is necessary to change the temperature ranges of the heating zones, there is a problem in that a product yield ratio is low.

The present invention has been completed in view of the situation described above, and aspects of the present invention aim to provide a method for manufacturing a galvanized steel sheet at a high product yield ratio having good surface appearance without surface defects by using a high-Si-containing steel sheet as a base steel sheet.

It is known that the amount of oxides formed on the surface of the base steel sheet depends on the furnace temperature and the oxygen concentration of the heating zone of the annealing furnace where a heat treatment is performed using a combustion reaction. The present inventors conducted investigations regarding factors influencing the variation in the oxidation amount of the high-Si-containing steel sheet other than the furnace temperature and the oxygen concentration of the heating zone. As a result, it was clarified that the variation in the oxidation amount depends strongly on the water vapor partial pressure $P_{H2O}^{in\ Air}$ of air fed into the heating zone, and that the variation in oxidation amount increases with increasing water vapor partial pressure, in particular, in the case where $P_{H2O}^{in\ Air}$ is 3000 Pa or less. That is, it was found that it is possible to stably manufacture a galvanized steel sheet excellent in terms of surface appearance quality and coating adhesiveness at a high product yield ratio as a result of the variation in the oxidation amount formed on the surface of the base steel sheet being decreased by controlling the furnace temperature based on the water vapor partial pressure $P_{H2O}^{in\ Air}$ of air fed into the heating zone.

The present invention has been completed on the basis of the findings described above, and exemplary embodiments of the present invention are described as follows.

[1] A method for manufacturing a galvanized steel sheet excellent in terms of surface appearance quality and coating adhesiveness, characterized by comprising;

heating a base steel sheet in a heating zone such that the surface of the base steel sheet is heated at a temperature of 600° C. or higher and 790° C. or lower while a furnace temperature T° C. in the heating zone of an annealing furnace is controlled based on the water vapor partial pressure $P_{H2O}^{in\ Air}$ of air fed into the heating zone, the base steel sheet having a chemical composition consisting of, by mass %, C: 0.05% or more and 0.25% or less, Si: 0.1% or more and 3.0% or less, Mn: 0.5% or more and 3.0% or less, P: 0.001% or more and 0.10% or less, Al: 0.01% or more and 3.00% or less, S: 0.200% or less, and the balance being Fe and inevitable impurities, heating the base steel sheet in the heating zone such that the surface of the base steel sheet is heated at a temperature of 630° C. or higher and 850° C. or lower in an atmosphere containing hydrogen gas having a partial pressure $P_{H2}$ of 1000 Pa or more and 50000 Pa or less, water vapor gas having a partial pressure $P_{H2O}$ of 610 Pa or less, and the balance being $N_2$ and inevitable impurities, and galvanizing the base steel sheet.

[2] The method for manufacturing a galvanized steel sheet excellent in terms of surface appearance quality and coating adhesiveness according to [1], characterized in that the furnace temperature T° C. is controlled so as to satisfy the following relationships;

$690-0.03\times P_{H2O}^{in\ Air} \leq T \leq 790-0.03\times P_{H2O}^{in\ Air}$ in the case where $P_{H2O}^{in\ Air} \leq 3000$ Pa, or $600 \leq T \leq 700$ in the case where $3000\ \text{Pa} < P_{H2O}^{in\ Air} \leq 20000$ Pa.

[3] The method for manufacturing a galvanized steel sheet excellent in terms of surface appearance quality and coating adhesiveness according to [1] or [2], characterized in that the chemical composition further contains Mo: 0.01% or more and 1.00% or less and/or Cr: 0.01% or more and 1.00% or less.

[4] The method for manufacturing a galvanized steel sheet excellent in terms of surface appearance quality and coating adhesiveness according to any one of [1] to [3], characterized in that alloying treatment is performed after galvanizing.

According to aspects of the present invention, it is possible to stably manufacture a galvanized steel sheet having good surface appearance without coating defects or pressing flaws. Here, since aspects of the present invention are effective in the case where a steel sheet containing Si in an amount of 0.1% or more, that is, a high-Si-containing steel sheet, which is generally difficult to be galvanized, is used as a base steel sheet, an embodiment of the present invention is effective for significantly increasing a product yield ratio in the manufacture of a high-Si-containing galvanized steel sheet.

BRIEF DESCRIPTION OF THE DRAWINGS

FIG. 1 is a correlation diagram illustrating the relationship between manufacturing conditions (the furnace temperature T and the water vapor partial pressure $P_{H2O}^{in\ Air}$ of air fed into the furnace) and the evaluation results of surface appearance.

DETAILED DESCRIPTION OF EMBODIMENTS OF THE INVENTION

Embodiments of the present invention will be specifically described hereafter.

First, a preferable chemical composition of a base steel sheet used in an embodiment of the present invention will be described. Here, % used when describing the content of an element represents mass %, unless otherwise noted.

C: 0.05% or more and 0.25% or less

It is beneficial that the C content be 0.05% or more in order to increase the strength of steel sheet. On the other hand, in the case where the C content is more than 0.25%, there is a decrease in weldability. Therefore, the C content is set to be 0.05% or more and 0.25% or less.

Si: 0.1% or more and 3.0% or less

Since Si is an element which is useful for improving the mechanical properties of high-strength steel sheet, it is desirable that the Si content be 0.1% or more. However, in the case where the Si content is more than 3.0%, it is difficult to prevent the formation of oxide layer, which results in a decrease in coating adhesiveness. Therefore, the Si content is set to be 0.1% or more and 3.0% or less.

Mn: 0.5% or more and 3.0% or less

Since Mn is an element for solid solution hardening and is effective for increasing the strength of steel sheet, it is useful that the Mn content be 0.5% or more. On the other hand, in the case where the Mn content is more than 3.0%, there is a decrease in weldability and coating adhesiveness, and it is difficult to achieve a good balance between strength and ductility. Therefore, the Mn content is set to be 0.5% or more and 3.0% or less.

P: 0.001% or more and 0.10% or less

Since P delays the progress of phase transformation by delaying the precipitation of cementite, it is useful that the P content be 0.001% or more. On the other hand, in the case where the P content is more than 0.10%, there is a decrease in weldability and coating adhesiveness, and in addition, since alloying is delayed, it is desirable to increase an alloying temperature, which results in a decrease in ductility. Therefore, the P content is set to be 0.001% or more and 0.10% or less.

Al: 0.01% or more and 3.00% or less

Al and Si are elements which are added in a complementary manner. Since Al is inevitably mixed into steel in a refining process, the lower limit of the Al content is 0.01%. On the other hand, in the case where the Al content is more than 3.00%, it is difficult to prevent the formation of oxide layer, which results in a decrease in coating adhesiveness. Therefore, the Al content is set to be 0.01% or more and 3.00% or less.

S: 0.200% or less

S is an element which is inevitably added in a refining process. However, in the case where the S content is large, there is a decrease in weldability. Therefore, the S content is set to be 0.200% or less.

In embodiments of the present invention, in addition to the elements described above, Mo and/or Cr may further be added.

Mo: 0.01% or more and 1.00% or less

Since Mo is an element which achieves the good balance between strength and ductility, Mo may be added in an amount of 0.01% or more. In addition, since Mo promotes, like Cr, the inner oxidation of Si and Al, Mo is effective for preventing the surface concentration of Si and Al. On the other hand, in the case where the Mo content is more than 1.00%, there may be an increase in cost. Therefore, in the case where Mo is added, it is preferable that the Mo content be 0.01% or more and 1.00% or less.

Cr: 0.01% or more and 1.00% or less

Since Cr is an element which achieves the good balance between strength and ductility, Cr may be added in an amount of 0.01% or more. In addition, since Cr promotes the inner oxidation of Si and Al, Cr is also effective for preventing the surface concentration of Si and Al. On the other hand, in the case where the Cr content is more than 1.00%, Cr is concentrated on the surface of steel sheet, which results in a decrease in coating adhesiveness and weldability. Therefore, in the case where Cr is added, it is preferable that the Cr content be 0.01% or more and 1.00% or less.

In embodiments of the present invention, in addition to the elements described above, the following elements may be added in accordance with desired properties.

Nb: 0.005% or more and 0.20% or less

Since Nb is an element which achieves the good balance between strength and ductility, Nb may be added in an amount of 0.005% or more. On the other hand, in the case where the Nb content is more than 0.20%, there may be an increase in cost. Therefore, in the case where Nb is added, it is preferable that the Nb content be 0.005% or more and 0.20% or less.

Ti: 0.005% or more and 0.20% or less

Since Ti is an element which achieves the good balance between strength and ductility, Ti may be added in an amount of 0.005% or more. On the other hand, in the case where the Ti content is more than 0.20%, there may be a decrease in coating adhesiveness. Therefore, in the case where Ti is added, it is preferable that the Ti content be 0.005% or more and 0.20% or less.

Cu: 0.01% or more and 0.50% or less

Since Cu is an element which promotes the formation of residual γ phase, Cu may be added in an amount of 0.01% or more. On the other hand, in the case where the Cu content is more than 0.5%, there may be an increase in cost. Therefore, in the case where Cu is added, it is preferable that the Cu content be 0.01% or more and 0.50% or less.

Ni: 0.01% or more and 1.00% or less

Since Ni is an element which promotes the formation of residual γ phase, Ni may be added in an amount of 0.01% or more. On the other hand, in the case where the Ni content is more than 1.00%, there may be an increase in cost. Therefore, in the case where Ni is added, it is preferable that the Ni content be 0.01% or more and 1.00% or less.

B: 0.0005% or more and 0.010% or less

Since B is an element which promotes the formation of residual γ phase, B is added in an amount of 0.0005% or more. On the other hand, in the case where the B content is more than 0.010%, there may be a decrease in coating adhesiveness. Therefore, in the case where B is added, it is preferable that the B content be 0.0005% or more and 0.010% or less.

The balance of the chemical composition other than the elements described above consists of Fe and inevitable impurities.

Subsequently, the method for manufacturing a galvanized steel sheet according to aspects of the present invention will be described with reference to exemplary embodiments.

A steel slab having the chemical composition described above is subjected to hot rolling followed by cold rolling and made into a steel sheet, and further, subjected to annealing and galvanizing using a continuous galvanizing line. In addition, an alloying treatment may be performed as needed after galvanizing. Here, at this time, one preferred aspect of the present invention is characterized in that the steel sheet is heated in the heating zone of an annealing furnace while a furnace temperature T in the heating zone of the annealing furnace is controlled based on the water vapor partial pressure $P_{H2O}^{in\ Air}$ of air fed into the heating zone, subsequently heated to a temperature of 630° C. or higher and 850° C. or lower in an atmosphere containing hydrogen gas having a partial pressure $P_{H2}$ of 1000 Pa or more and 50000 Pa or less, water vapor gas having a partial pressure $P_{H2O}$ of 610 Pa or less, and the balance being $N_2$ and inevitable impurities, and subjected to galvanizing thereafter. This is an advantageous feature in embodiments of the present invention.

Hot Rolling

Hot rolling may be performed under commonly used conditions.

Pickling

It is preferable that pickling treatment be performed after hot rolling. After scale, which has been formed on the surface of steel sheet, is removed using a pickling process, cold rolling is performed. Here, there is no limitation on the pickling conditions.

Cold Rolling

It is preferable that cold rolling be performed at a reduction rate of 30% or more and 90% or less. In the case where the reduction rate is less than 30%, since recrystallization is delayed, there is a tendency for mechanical properties to deteriorate. On the other hand, in the case where the reduction rate is more than 90%, there is not only an increase in rolling cost but also a deterioration in coating performance due to an increase in surface concentration at annealing.

Subsequently, the cold-rolled steel sheet is subjected to annealing and then to galvanizing. In embodiments of the present invention, by heating the steel sheet in the heating zone of an annealing furnace while controlling the furnace temperature T° C. of the heating zone of the annealing furnace based on the water vapor partial pressure $P_{H2O}^{in\ Air}$ of air fed into the furnace, since there is a decrease in variation in the amount of oxides formed on the surface of high-Si-containing steel sheet, it is possible to provide a method for manufacturing a galvanized steel sheet at a high product yield ratio.

Heat Treatment Condition

The heating which is performed using a combustion reaction in the heating zone of an annealing furnace is performed in order to form Fe-based oxides on the surface of steel sheet. Conventionally, it is known that the amount of oxides formed on the surface of steel sheet depends on the furnace temperature and the oxygen concentration in the heating zone of the annealing furnace. The present inventors found that the amount of oxides formed on the surface of steel sheet strongly depends on the amount of water vapor contained in air fed into the furnace in addition to the furnace temperature and the oxygen concentration. Specifically, in the case where the water vapor partial pressure $P_{H2O}^{in\ Air}$ of air fed into the heating zone is 3000 Pa or less, an oxidation rate linearly increases with increasing water vapor partial pressure. This is thought to be because, in the case where $P_{H2O}^{in\ Air}$ is 3000 Pa or less, there is an increase in defects in oxides due to the intrusion of water vapor into the oxides. On the other hand, it was found that, in the case where $P_{H2O}^{in\ Air}$ is more than 3000 Pa, the oxidation rate hardly depends on the water vapor partial pressure and remains almost constant. This is thought to be because, in the case where $P_{H2O}^{in\ Air}$ is more than 3000 Pa, since the intrusion of water vapor into the oxides is saturated, the defects do not increase further.

On the basis of the findings described above, aspects of the present invention include that the surface of steel sheet is heated at a temperature of 600° C. or higher and 790° C. or lower while a furnace temperature T° C. of the heating zone of the annealing furnace is controlled based on the water vapor partial pressure $P_{H2O}^{in\ Air}$ of air fed into the heating zone of the annealing furnace. Here, the water vapor partial pressure of air fed into the furnace varies depending on the atmospheric temperature and humidity and the performance of a dehumidification and humidification device. It is preferable that $P_{H2O}^{in\ Air}$ be 20000 Pa or less from the viewpoint of manufacturing costs and protection of the furnace inside.

In embodiments of the present invention, it is preferable that the furnace temperature T° C. in the heating zone of an annealing furnace be controlled to be within the following range:

in the case where $P_{H2O}^{in\ Air} \leq 3000$ Pa; $690-0.03\times P_{H2O}^{in\ Air} \leq T \leq 790-0.03\times P_{H2O}^{in\ Air}$, and in the case where $3000\ Pa < P_{H2O}^{in\ Air} \leq 20000$ Pa; $600 \leq T \leq 700$.

In the case where $P_{H2O}^{in\ Air}$ 3000 Pa, when T is lower than $690-0.03\times P_{H2O}^{in\ Air}$ since there is an insufficient oxidation amount, coating defects occur. In addition, when T is higher than $790-0.03\times P_{H2O}^{in\ Air}$ since there is an excessive oxidation amount, pressing flaws occur.

In the case where $3000\ Pa < P_{H2O}^{in\ Air} \leq 20000$ Pa, if T is lower than 600° C., since there is an insufficient oxidation amount, coating defects occur. When T is higher than 700° C., since there is an excessive oxidation amount, pressing flaws occur.

Here, it is possible to determine the water vapor partial pressure in the fed air using, for example, a mirror surface-type dew point meter or a capacitance-type dew point meter, and it is possible to decrease a variation in the oxidation amount formed on the surface of steel sheet by feedback controlling the furnace temperature within the ranges described above based on the determined water vapor partial pressure.

Annealing conditions after heat treatment has been performed

The annealing for a steel sheet after the heating is performed in order to perform a reduction treatment on the surface of steel sheet. In embodiments of the present invention, it is beneficial that the hydrogen partial pressure $P_{H2}$ be 1000 Pa or more in order to obtain sufficient reduction capability. On the other hand, in the case where $P_{H2}$ is more than 50000 Pa, there is an increase in operation cost. In addition, in the case where the water vapor partial pressure $P_{H2O}$ is more than 610 Pa, since oxides are less likely to be reduced, there is a decrease in coating performance. Therefore, after heating has been performed, annealing is performed in an atmosphere containing hydrogen gas having a partial pressure $P_{H2}$ of 1000 Pa or more and 50000 Pa or less and water vapor gas having a partial pressure $P_{H2O}$ of 610 Pa or less, and the balance being $N_2$ and inevitable impurities.

In such an atmosphere, reduction annealing is performed by heating the steel sheet at a temperature of 630° C. or higher and 850° C. or lower. In the case where the temperature of the steel sheet is lower than 630° C., since recrystallization is delayed, there is a deterioration in mechanical properties. In the case where the temperature of the steel sheet is higher than 850° C., since surface concentration is promoted, coating defects occur.

Galvanizing Treatment

After annealing has been performed, galvanizing treatment is performed. In addition, after galvanizing treatment, alloying treatment may be performed as needed in order to manufacture a galvannealed steel sheet. It is preferable that the temperature of Zn bath be 440° C. or higher and 550° C. or lower when galvanizing treatment is performed. It is not appropriate that the bath temperature be lower than 440° C., because the solidification of Zn may occur due to a large variation in temperature inside the bath. On the other hand, in the case where the bath temperature is higher than 550° C., since the vaporization of the Zn bath becomes significant, there is an increase in operation cost or there is a deterioration in operation environment, and in addition, since alloying progresses at galvanizing, excessive alloying tends to occur.

In the case where alloying treatment is not performed, it is preferable that Al concentration in the bath be 0.14 mass % or more and 0.24 mass % or less. In the case where the Al concentration is less than 0.14 mass %, Fe—Zn alloying reaction progresses at galvanizing treatment, which results in a variation in surface appearance. On the other hand, in the case where the Al concentration is more than 0.24 mass %, since a thick Fe—Al alloy layer is formed at the interface of the coated layer and the base steel sheet at galvanizing treatment, there is a decrease in weldability, and in addition, since the Al concentration in the bath is high, a large amount of Al oxide layer attaches to the surface of steel sheet, there is a significant deterioration in surface appearance.

In the case where alloying treatment is performed, it is preferable that the Al concentration in the bath be 0.10% or more and 0.20% or less. In the case where the Al concentration is less than 0.10%, since a hard and brittle Fe—Zn alloy layer is formed at the interface of the coated layer and the base steel sheet at galvanizing treatment, there is a decrease in coating adhesiveness. On the other hand, in the case where the Al concentration is more than 0.20%, since a thick Fe—Al alloy layer is formed at the interface of the coated layer and the base steel sheet immediately after the dipping in the bath, there is a decrease in weldability.

In addition, Mg may be added to the Zn bath in order to increase corrosion resistance.

Subsequently, an alloying treatment is performed as needed. It is appropriate that the alloying temperature be 460° C. or higher and 570° C. or lower. In the case where the alloying temperature is lower than 460° C., alloying reaction is slow, while, in the case where the alloying temperature is higher than 570° C., since a hard and brittle thick Fe—Zn alloy layer is formed at the interface of the coated layer and the base steel sheet, there is a decrease in coating performance. Coating weight is not specified in particular. It is preferable that the coating weight be 10 g/m$^2$ or more from the viewpoint of corrosion resistance and coating weight control, and it is preferable that coating weight be 120 g/m$^2$ or less from the viewpoint of formability and economic efficiency.

EXAMPLE 1

Aspects of the present invention will be described based on examples hereafter.

Slabs having chemical compositions given in Table 1 were heated at a temperature of 1260° C. for 60 minutes in a heating furnace, hot-rolled into a thickness of 2.8 mm, and then coiled at a temperature of 540° C. Subsequently, after scale had been removed by pickling, the coiled steel sheets were cold-rolled into a thickness of 1.6 mm. Then, a heat treatment was performed under the conditions given in Table 2 using a DFF-type CGL having divided heating zones. After heat treatment, the steel sheets were dipped in an Al-containing Zn bath having a temperature of 460° C. in order to obtain galvanized steel sheets (GI), and then the galvanized steel sheets were subjected to alloying treatment in order to obtain galvannealed steel sheets (GA). Here, the Al concentration in the bath was 0.10% to 0.20%, and the coating weight was controlled to be 45 g/m$^2$ by using a gas wiping method. The alloying treatment was performed at a temperature of 550° C. to 560° C.

TABLE 1

| | Chemical Composition/mass % | | | | | | | | | | | | | |
|---|---|---|---|---|---|---|---|---|---|---|---|---|---|---|
| Steel | C | Si | Mn | P | Al | S | Mo | Cr | Nb | Ti | Cu | Ni | B | Note |
| A | 0.10 | 1.0 | 1.0 | 0.01 | 0.03 | 0.003 | — | — | — | — | — | — | — | within Scope of Invention |
| B | 0.08 | 1.4 | 1.2 | 0.05 | 0.03 | 0.003 | — | — | — | — | — | — | — | within Scope of Invention |
| C | 0.15 | 1.5 | 2.5 | 0.01 | 0.03 | 0.008 | 0.02 | — | — | — | — | — | — | within Scope of Invention |
| D | 0.12 | 1.1 | 0.5 | 0.05 | 0.60 | 0.008 | — | 0.05 | — | — | — | — | — | within Scope of Invention |
| E | 0.12 | 3.0 | 0.7 | 0.05 | 1.00 | 0.008 | 0.07 | 0.03 | — | — | — | — | — | within Scope of Invention |
| F | 0.09 | 0.5 | 0.4 | 0.03 | 0.50 | 0.002 | 0.10 | 0.01 | 0.05 | — | — | — | — | within Scope of Invention |
| G | 0.06 | 0.1 | 1.0 | 0.05 | 0.80 | 0.010 | 0.30 | 0.04 | — | 0.02 | — | — | — | within Scope of Invention |
| H | 0.13 | 0.2 | 1.5 | 0.01 | 0.05 | 0.003 | 0.02 | — | 0.08 | 0.03 | 0.20 | — | — | within Scope of Invention |
| I | 0.18 | 0.5 | 0.6 | 0.08 | 0.20 | 0.023 | 0.06 | 0.06 | 0.10 | — | 0.01 | 0.50 | — | within Scope of Invention |
| J | 0.07 | 0.8 | 2.2 | 0.02 | 0.08 | 0.001 | 0.15 | 0.20 | — | 0.10 | — | — | 0.001 | within Scope of Invention |
| K | 0.10 | 0.8 | 1.0 | 0.04 | 0.40 | 0.015 | 0.25 | 0.50 | 0.01 | 0.15 | 0.05 | 0.02 | 0.001 | within Scope of Invention |
| L | 0.30 | 3.5 | 0.8 | 0.06 | 0.30 | 0.026 | 0.50 | 0.02 | — | — | — | — | — | out of Scope of Invention |
| M | 0.13 | 0.4 | 3.2 | 0.15 | 0.10 | 0.001 | 0.02 | — | — | 0.05 | 0.25 | — | — | out of Scope of Invention |
| N | 0.50 | 0.6 | 0.7 | 0.08 | 3.50 | 0.300 | 0.05 | 0.08 | 0.07 | — | 0.02 | — | — | out of Scope of Invention |
| O | 0.15 | 4.0 | 2.5 | 0.02 | 0.08 | 0.001 | 1.20 | 0.45 | — | 0.12 | — | — | 0.001 | out of Scope of invention |
| P | 0.35 | 0.8 | 3.5 | 0.04 | 0.40 | 0.015 | 0.35 | 1.50 | 0.04 | 0.07 | 0.05 | 0.02 | 0.001 | out of Scope of Invention |

The surface appearance and coating adhesiveness of the steel sheets obtained as described above were evaluated using the following methods.

(1) Surface Appearance

Surface appearance was evaluated based on the following, standard by performing a visual test on a region of 300×300 mm of the steel sheet surface.

○: without coating defects nor pressing flaws

Δ: generally satisfactory, but with coating defects at low frequency

▲: generally satisfactory, but with pressing flaws at low frequency x: poor surface appearance with coating defects or pressing flaws (2) Coating Adhesiveness By sticking a cellophane tape to the steel sheet surface, and performing bending and unbending at a right angle on the steel sheet, the amount per unit length of Zn peeled was determined in terms of Zn count number using a fluorescent X-ray method. Then, coating adhesiveness was evaluated based on the following standard. Here, in this test, the mask diameter was 30 mm, the acceleration voltage of the fluorescent X-ray was 50 kV, the acceleration current of the fluorescent X-ray was 50 mA, and the measuring time was 20 seconds.

○: Zn count number was 0 to 5000

Δ: Zn count number was 5000 to 10000 x: Zn count number was 10000 or more

The obtained results are given in Table 2.

TABLE 2

| | | Heat Treatment Condition | | | Annealing Condition after Heat Treatment | | | | | | |
|---|---|---|---|---|---|---|---|---|---|---|---|
| Steel Sheet No. | Steel | $P_{H2O}^{in\ Air}$/Pa | Temperature of Steel Sheet Surface/° C. | Furnace Temperature T of Invention/° C. | $P_{H2}$/Pa | $P_{H2O}$/Pa | Temperature of Steel Sheet Surface/° C. | Kind of Coating | Surface Appearance | Coating Adhesiveness | Note |
| 1 | A | 100 | 715 | 687-787 | 10000 | 80 | 820 | GA | ○ | ○ | Example |
| 2 | A | 100 | 770 | 687-787 | 10000 | 610 | 820 | GI | ○ | ○ | Example |
| 3 | A | 100 | 650 | 687-787 | 10000 | 30 | 820 | GA | Δ | Δ | Comparative Example |
| 4 | A | 100 | 835 | 687-787 | 10000 | 20 | 820 | GA | x | x | Comparative Example |
| 5 | A | 1000 | 750 | 660-760 | 10000 | 30 | 820 | GA | ○ | ○ | Example |
| 6 | A | 1000 | 695 | 660-760 | 10000 | 200 | 820 | GI | ○ | ○ | Example |
| 7 | A | 1000 | 815 | 660-760 | 10000 | 35 | 820 | GI | ▲ | x | Comparative Example |
| 8 | A | 1000 | 620 | 660-760 | 10000 | 150 | 820 | GI | Δ | Δ | Comparative Example |
| 9 | A | 1000 | 580 | 660-760 | 10000 | 40 | 820 | GA | x | x | Comparative Example |
| 10 | A | 2500 | 705 | 615-715 | 10000 | 20 | 820 | GA | ○ | ○ | Example |
| 11 | A | 2500 | 650 | 615-715 | 10000 | 60 | 820 | GA | ○ | ○ | Example |
| 12 | A | 2500 | 680 | 615-715 | 10000 | 20 | 820 | GI | ○ | ○ | Example |
| 13 | A | 2500 | 750 | 615-715 | 10000 | 20 | 820 | GA | ▲ | Δ | Comparative Example |
| 14 | A | 2500 | 780 | 615-715 | 10000 | 250 | 820 | GA | ▲ | x | Comparative Example |
| 15 | A | 2500 | 595 | 615-715 | 10000 | 40 | 820 | GA | Δ | Δ | Comparative Example |
| 16 | A | 5000 | 610 | 600-700 | 10000 | 50 | 820 | GA | ○ | ○ | Example |
| 17 | A | 5000 | 650 | 600-700 | 10000 | 300 | 820 | GI | ○ | ○ | Example |
| 18 | A | 5000 | 550 | 600-700 | 10000 | 20 | 820 | GA | Δ | x | Comparative Example |
| 19 | A | 5000 | 750 | 600-700 | 10000 | 20 | 820 | GA | x | x | Comparative Example |
| 20 | A | 10000 | 675 | 600-700 | 10000 | 15 | 820 | GA | ○ | ○ | Example |
| 21 | A | 10000 | 620 | 600-700 | 10000 | 400 | 820 | GA | ○ | ○ | Example |
| 22 | A | 10000 | 720 | 600-700 | 10000 | 15 | 820 | GA | ▲ | x | Comparative Example |
| 23 | A | 10000 | 570 | 600-700 | 10000 | 40 | 820 | GA | Δ | x | Comparative Example |
| 24 | A | 10000 | 735 | 600-700 | 10000 | 40 | 820 | GI | x | x | Comparative Example |
| 25 | B | 100 | 720 | 687-787 | 10000 | 30 | 820 | GA | ○ | ○ | Example |
| 26 | B | 100 | 650 | 687-787 | 10000 | 35 | 820 | GA | x | x | Comparative Example |
| 27 | C | 1000 | 700 | 660-760 | 10000 | 25 | 820 | GI | ○ | ○ | Example |
| 28 | D | 1000 | 710 | 660-760 | 10000 | 30 | 820 | GA | ○ | ○ | Example |
| 29 | E | 2500 | 725 | 615-715 | 10000 | 50 | 820 | GA | ▲ | x | Comparative Example |
| 30 | F | 1000 | 680 | 660-760 | 10000 | 30 | 810 | GA | ○ | ○ | Example |
| 31 | G | 1000 | 720 | 660-760 | 10000 | 15 | 810 | GA | ○ | ○ | Example |
| 32 | H | 2000 | 700 | 630-730 | 10000 | 20 | 810 | GI | ○ | ○ | Example |
| 33 | I | 2000 | 675 | 630-730 | 10000 | 120 | 810 | GA | ○ | ○ | Example |
| 34 | J | 3000 | 680 | 600-700 | 10000 | 20 | 810 | GI | ○ | ○ | Example |
| 35 | K | 3000 | 670 | 600-700 | 10000 | 140 | 810 | GA | ○ | ○ | Example |

TABLE 2-continued

| Steel Sheet No. | Steel | Heat Treatment Condition: $P_{H2O}^{in\ Air}$/Pa | Heat Treatment Condition: Temperature of Steel Sheet Surface/° C. | Heat Treatment Condition: Furnace Temperature T of Invention/° C. | Annealing Condition after Heat Treatment: $P_{H2}$/Pa | Annealing Condition after Heat Treatment: $P_{H2O}$/Pa | Annealing Condition after Heat Treatment: Temperature of Steel Sheet Surface/° C. | Kind of Coating | Surface Appearance | Coating Adhesiveness | Note |
|---|---|---|---|---|---|---|---|---|---|---|---|
| 36 | L | 100 | 690 | 687-787 | 10000 | 20 | 810 | GA | x | Δ | Comparative Example |
| 37 | M | 1000 | 750 | 660-760 | 10000 | 150 | 820 | GA | Δ | Δ | Comparative Example |
| 38 | N | 1000 | 665 | 660-760 | 10000 | 50 | 810 | GI | x | x | Comparative Example |
| 39 | O | 2500 | 620 | 615-715 | 10000 | 80 | 810 | GA | x | Δ | Comparative Example |
| 40 | P | 2500 | 710 | 615-715 | 10000 | 100 | 810 | GI | Δ | x | Comparative Example |

From the results given in Table 2, it is clarified that the surfaces of all the galvanized steel sheets according to embodiments of the present invention (examples in Table 2) have good surface appearance and excellent coating adhesiveness. That is, there is a significant increase in product yield ratio compared with conventional examples.

FIG. 1 is a correlation diagram illustrating the relationship between the manufacturing conditions (the furnace temperature T and the water vapor partial pressure $P_{H2O}^{in\ Air}$ of air fed into the furnace) and the evaluation results of surface appearance in the case of steel A given in Table 2. As FIG. 1 indicates, it is clarified that all the galvanized steel sheets according to aspects of the present invention have good surface appearance.

In addition, the comparative examples of conventional techniques are also illustrated in FIG. 1. For example, in the case where the furnace temperature in the heating zone is controlled to be 750° C. (comparative example 1 of conventional technique), the satisfactory surface appearance can be obtained when $P_{H2O}^{in\ Air}$ is 100 Pa or 1000 Pa. However, when $P_{H2O}^{in\ Air}$ is 2500 Pa or 5000 Pa, pressing flaws occur. In the same way, in the case where the furnace temperature is controlled to be 650° C. (comparative example 2 of conventional technique), coating defects occur when $P_{H2O}^{in\ Air}$ is 100 Pa. That is, in the case of the conventional technique, although unsatisfactory surface appearance occurs when the furnace temperature is simply controlled to be constant (Δ, ▲, and x on the dotted lines for comparative examples 1 and 2 of conventional technique), it is clarified that unsatisfactory surface appearance does not occur when water vapor partial pressure is controlled as is the case with embodiments of the present invention (○ on the dotted lines for comparative examples 1 and 2 of conventional technique).

As described above, according to aspects of the present invention, a galvanized steel sheet having good surface appearance and excellent coating adhesiveness is stably manufactured. That is, there is a significant increase in product yield ratio compared with the conventional manufacturing methods.

Since the galvanized steel sheet according to aspects of the present invention is excellent in terms of surface appearance and coating adhesiveness as well as mechanical properties, it is expected that the galvanized steel sheet is used for wide applications mainly including the fields of automobile, domestic electric appliance, and building material.

The invention claimed is:

1. A method for manufacturing a galvanized steel sheet, the method comprising;

heating a base steel sheet in a heating zone such that a surface of the base steel sheet is heated at a temperature of 600° C. or higher and 790° C. or lower, the base steel sheet having a chemical composition containing, by mass %, C: 0.05% or more and 0.25% or less, Si: 0.1% or more and 3.0% or less, Mn: 0.5% or more and 3.0% or less, P: 0.001% or more and 0.10% or less, Al: 0.01% or more and 3.00% or less, S: 0.200% or less, and the balance being Fe and inevitable impurities, during the heating, controlling a furnace temperature T° C. in the heating zone of an annealing furnace based on the water vapor partial pressure $P_{H2O}^{in\ Air}$ of air fed into the heating zone, subsequently, heating the base steel sheet in the heating zone such that the surface of the base steel sheet is heated at a temperature of 630° C. or higher and 850° C. or lower in an atmosphere containing hydrogen gas having a partial pressure $P_{H2}$ of 1000 Pa or more and 50000 Pa or less, water vapor gas having a partial pressure $P_{H2O}$ of 610 Pa or less, and the balance being $N_2$ and inevitable impurities, and galvanizing the base steel sheet.

2. The method for manufacturing a galvanized steel sheet according to claim 1, wherein the furnace temperature T° C. is controlled so as to satisfy the following relationships:

$690-0.03\times P_{H2O}^{in\ Air} \leq T \leq 790-0.03\times P_{H2O}^{in\ Air}$ in the case where $P_{H2O}^{in\ Air} \leq 3000$ Pa, or $600 \leq T \leq 700$ in the case where $3000\ \text{Pa} < P_{H2O}^{in\ Air} \leq 20000$ Pa.

3. The method for manufacturing a galvanized steel sheet according to claim 2, wherein the chemical composition further contains Mo: 0.01% or more and 1.00% or less and/or Cr: 0.01% or more and 1.00% or less.

4. The method for manufacturing a galvanized steel sheet according to claim 3, wherein alloying treatment is performed after galvanizing.

5. The method for manufacturing a galvanized steel sheet according to claim 2, wherein alloying treatment is performed after galvanizing.

6. The method for manufacturing a galvanized steel sheet according to claim 1, wherein the chemical composition further contains Mo: 0.01% or more and 1.00% or less and/or Cr: 0.01% or more and 1.00% or less.

7. The method for manufacturing a galvanized steel sheet according to claim 6, wherein alloying treatment is performed after galvanizing.

8. The method for manufacturing a galvanized steel sheet according to claim 1, wherein alloying treatment is performed after galvanizing.

* * * * *